US005331382A

United States Patent [19]

Miura et al.

[11] Patent Number: 5,331,382

[45] Date of Patent: Jul. 19, 1994

[54] TONER CARTRIDGE FOR IMAGE FORMING APPARATUS

[75] Inventors: Kanenori Miura; Shiro Suzuki; Yasuhito Takahashi; Masaru Ono, all of Kanagawa, Japan

[73] Assignee: Fuji Xerox Co., Ltd., Tokyo, Japan

[21] Appl. No.: 142,114

[22] Filed: Oct. 28, 1993

Related U.S. Application Data

[63] Continuation of Ser. No. 848,873, Mar. 10, 1992, abandoned.

[30] Foreign Application Priority Data

Mar. 18, 1991 [JP] Japan ..... 3-52565

[51] Int. Cl.[5] ..... G03G 15/06

[52] U.S. Cl. ..... 355/260; 355/245

[58] Field of Search ..... 355/200, 210, 245, 251, 355/253, 260; 222/DIG. 1

[56] References Cited

U.S. PATENT DOCUMENTS

| | | | |
|---|---|---|---|
| 4,740,808 | 4/1988 | Kasamura et al. | 355/260 |
| 4,876,577 | 10/1989 | Ogura et al. | 355/260 X |
| 4,887,132 | 12/1989 | Joseph et al. | 355/253 |
| 4,937,628 | 6/1990 | Cipolla et al. | 355/260 |
| 4,956,675 | 9/1990 | Joseph | 355/251 |
| 4,987,446 | 1/1991 | Mochimaru et al. | 355/200 |
| 5,025,289 | 6/1991 | Guslits et al. | 355/253 |
| 5,091,750 | 2/1992 | Yoshida et al. | 355/260 |

*Primary Examiner*—A. T. Grimley
*Assistant Examiner*—Sandra L. Brasé
*Attorney, Agent, or Firm*—Finnegan, Henderson Farabow, Garrett & Dunner

[57] ABSTRACT

A toner cartridge for an image forming apparatus including a case body having a tubular portion, first and second end walls, and first and second positioning members. The first positioning member radially protrudes from the first end wall and has a flat end face. The first positioning member, which is used for positioning the toner cartridge at the start of loading the toner cartridge into the image forming apparatus, is aligned with a first guide in the image forming apparatus at the start of loading the toner cartridge. The second positioning member, which radially protrudes from the second end wall of the cartridge and has a flat end face, is angularly shifted from the first positioning member. After the first positioning member is aligned with the guide, the cartridge is rotated to align the second positioning member with a second guide in said image forming apparatus.

5 Claims, 11 Drawing Sheets

TONER CARTRIDGE FOR IMAGE FORMING APPARATUS

This application is a continuation of application Ser. No. 07/848,873, filed Mar. 10, 1992, now abandoned.

BACKGROUND OF THE INVENTION

1. Field of the Invention

The present invention relates to a toner cartridge used for supplying toner to a developing unit of an image forming apparatus, and more particularly to a cartridge of the throwaway type which is used by being attached to a toner supply unit of an image forming apparatus.

2. Related Art

In a conventional toner supply device for supplying toner to a developing unit of a copying machine, a toner box is installed in a main body of the copying machine. Toner is supplied from the toner box to the developing unit by means of an auger. When toner is used up in the toner box, the toner box is pulled out to a toner supply position, and toner contained in a spare toner bottle is supplied to the toner box. In the toner supply work, toner tends to scatter and stain user's hands, clothes, and the like therewith. The kinds of toner supplied are different for the types of the copying machines used. These facts make user's toner supply work difficult and complicated. For this reason, the toner supply work is usually done by a serviceman.

In the copying machine thus arranged for the toner supply, the user must call a serviceman every time toner is used up. This is troublesome for the user. Further, if the serviceman arrives, toner is not always quickly supplied to the machine. This is time consuming and use of the copying machine is almost impossible till the toner supply work is completed. The result is inefficient use of the copying machine.

Further, in the toner supply work, the user often experiences that leaked toner drops on the floor on which the machine is located, or sticks to clothes. There is a proposal that a cartridge filled with toner is used in place of the conventional toner bottle. In the copying machine using the cartridge, when loaded to the machine, the cartridge is set to the toner box, and a cap is removed from the cartridge, and then toner is supplied. After the toner supply is completed, the cartridge is removed from the machine. The proposal succeeded in lessening such a chance that the leaked toner drop on the floor or sticks to the clothes.

The toner supply work for the machine using the cartridge requires at least three actions; 1) to set the cartridge to the toner box, 2) to supply toner to the toner box, and 3) to remove the cartridge. This is troublesome work. The serviceman call is still needed for the toner supply work. Accordingly, as in the case using the toner bottle, when toner is used up, the user must call a serviceman, and much time is taken till the serviceman comes and he completes the toner supply. Further, when the cartridge is removed after toner is supplied, toner tends to leak and stain user's clothes therewith.

SUMMARY OF THE INVENTION

The present invention has been made in view of the above circumstances and, accordingly, an object of the invention is to provide a toner cartridge for a toner supply unit of an image forming apparatus which can prevent the troublesome and complicated toner supply operation using the toner cartridge, and can surely prevent toner from spilling from the cartridge when it is set to and removed from the toner box.

To solve the above problems, in the invention as set forth in claim 1, a toner cartridge is removably loaded to a toner supply unit of an image forming apparatus and is used being attached to the toner supply unit. The toner cartridge comprises a first positioning means for positioning the toner cartridge at the start of cartridge loading, and a second positioning means for positioning the toner cartridge at the completion of the cartridge loading. At the start of cartridge loading, the flat end face of the protruded first positioning means is set horizontally. After the cartridge loading is completed, the flat end face of the protruded second positioning means, which is located at the rear end of the cartridge, is set horizontally.

To load the toner cartridge, the first positioning means is horizontally directed and set at a prescribed position, and under this condition the loading operation of the toner cartridge starts. When the second positioning means is directed horizontally through a proper operation for loading, for example, the operation of turning the toner cartridge, the loading of the toner cartridge is completed. At the start of cartridge loading, the first positioning means is used as a reference, and at the completion of the cartridge loading the second positioning means is used as a reference. Therefore, the mistaken operation of loading the toner cartridge can be completely eliminated. In addition, the positioning of the toner cartridge is further simplified.

The width of the end face of the protruded first positioning means and that of the end face of the protruded second positioning means are different from each other. Because of this, there is eliminated such a case where a user mistakenly recognizes the first positioning means as the second positioning means and vice versa. Accordingly, in loading the toner cartridge, the user will rarely mistake the loading direction of the cartridge.

In the invention as set forth in claim 2, the cartridge further comprises a toner supply port for discharging toner contained therein, and a shutter, slidably movable, for opening and closing the toner supply port. The shutter is moved interlocking with the loading and removal operations of the toner cartridge in a manner that the shutter closes the toner supply port when the toner cartridge is removed, and opens the toner supply port when the loading of the toner cartridge is completed.

With the thus constructed combination of the toner supply port and the shutter, the toner supply port of the toner cartridge is closed when the cartridge is not loaded. When it is loaded, the shutter is moved interlocking with the loading operation, so that the toner supply port automatically opens. When the cartridge is removed, the shutter is moved interlocking with the removal operation, so that the toner supply port automatically closes. Thus, in other states of the cartridge than the loaded state, the toner supply port is closed without fail. Accordingly, the loading and removal of the cartridge may be carried out free from the soiling of clothes, machine or the like with the spilt toner.

DESCRIPTION OF THE PREFERRED EMBODIMENT

A preferred embodiment of the present invention will be described in detail with reference to the accompanying drawings.

Figure 1:
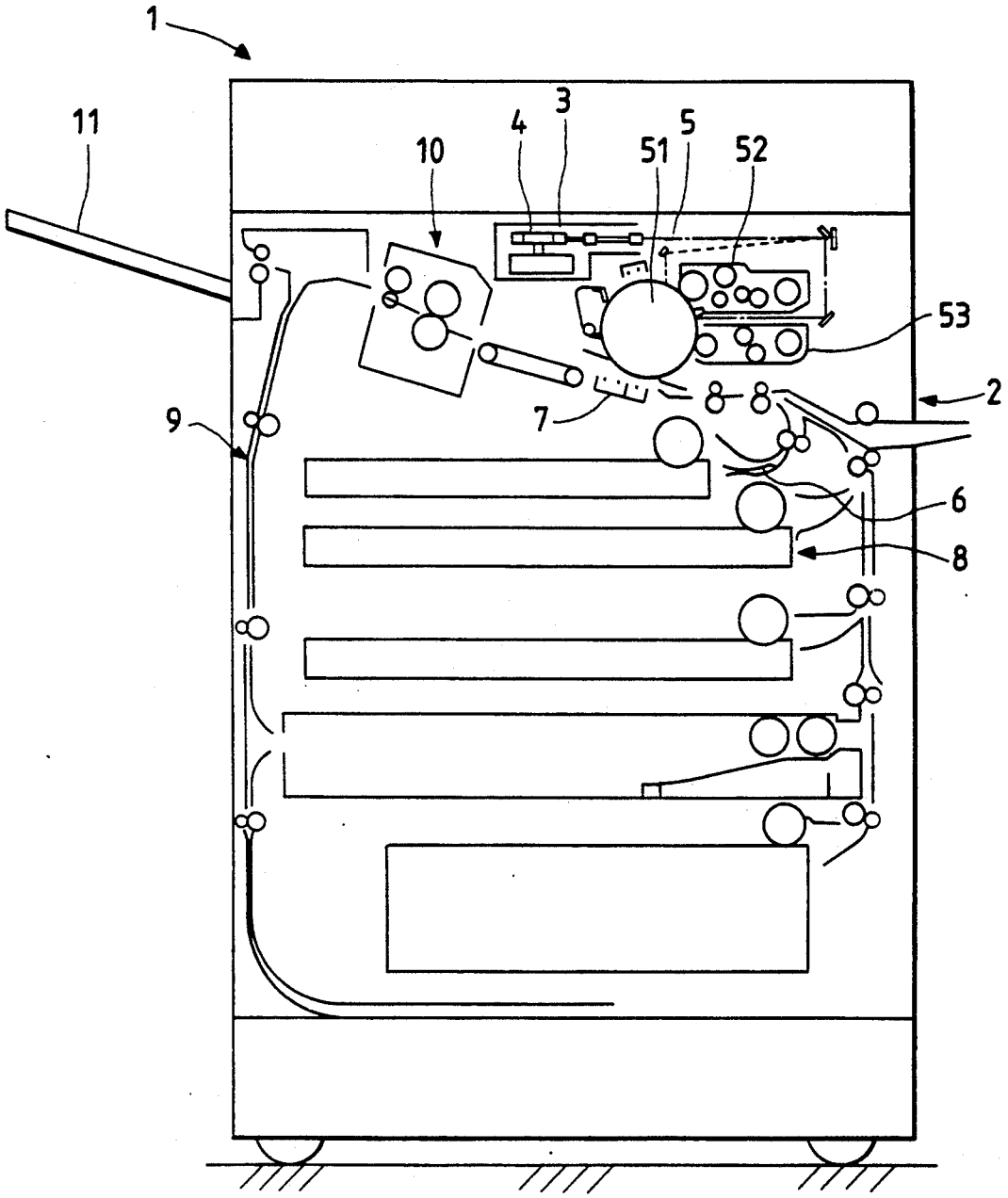
FIG. 1 is a longitudinal sectional view showing a color copying machine to which a toner cartridge according to an embodiment of the invention is applied.

FIG. 1 is a sectional view showing a color copying machine to which a first embodiment of the invention is applied.

As shown in FIG. 1, a color copying machine 1 comprises a main body 2, a platen 3 which is provided on the top surface of the main body 2 and on which an original document is to be placed, an image reader 4 which is provided under the platen 3 and for reading picture information on the original, an image forming unit 5 for receiving image signals from the image reader 4 and forming a prescribed image according to the image signals, a transfer unit 7 for transferring an image formed by the image forming unit 5 onto a recording paper 6 as an image transfer media, a paper supply section 8 and a paper forwarding section 9 for supplying and forwarding the paper 6, a fixing unit 10 for fixing a toner image which has been transferred onto the recording paper beam 6 by the image forming unit 5, and an exit tray 11 for receiving the paper 6 bearing the toner image fixed thereon.

The image forming unit 5 includes a photoreceptor 51 taking the form of a drum, and first and second developing means 52 and 53 located adjacent to the photoreceptor 51. The first developing means 52 contains a two-component color developer, and the second developing means 53 contains a two-component black developer.

The first and second developing means 52 and 53 are moved to be brought into contact with and to be detached from the photoreceptor 51 by means of retracting mechanisms (not shown), which are provided in association with the first and second developing means.

The second developing means 53 to which a toner cartridge for a toner supply unit according to the present embodiment is installed, will be described in more detail.

Figure 2:
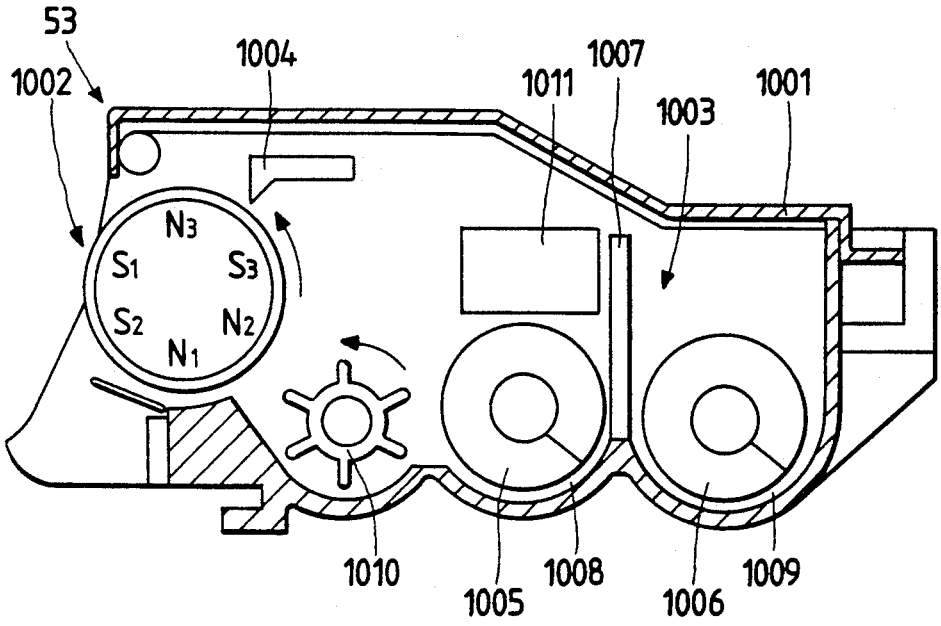
FIG. 2 is an enlarged sectional view showing a developing means of the color copying machine.

As shown in FIG. 2, the second developing means 53 develops a second latent image formed on the photoreceptor 51. The second developing means 53 generally includes a developing roll (developer bearing member) 1002, a developer agitating means 1003, and a trimmer plate (trimmer) 1004. The developing roll 1002 is disposed such that its outer spherical surface is partially exposed to the outside of the housing through an opening formed at one end of a housing 1001. The developer agitating means 1003 is disposed on the rear side of the developing roll 1002 within the housing 1001. The trimmer plate 1004 is mounted on the top plate of the housing 1001, which is above the developing roll 1002, and regulates the bristle height of the magnetic brush of the developer distributed on the developing roll 1002.

Tracking rolls (not shown) are rotatably provided on both sides of the developing roll 1002. The tracking rolls are brought into contact with the photoreceptor 51, to maintain a required gap between the developing roll 1002 and the photoreceptor 51.

The agitating means 1003 includes first and second augers 1005 and 1006, which are parallel to the developing roll 1002 in the axial direction, and a partitioning plate 1007, erected in the housing 1001, for partitioning the two augers one from the other. The augers 1005 and 1006 are rotated in such directions that the developer transfer directions are opposite to each other. At both end portions of the partitioning wall 1007, openings are formed through which a region (referred to as a first agitating path 1008) where the first auger 1005 is disposed, communicates with a region (referred to as a second agitating path 1009) where the second auger 1006 is disposed. Through the openings, the developer circulates through a route; first agitating path 1008→second agitating path 1009→first agitating path 1008.

A paddle wheel 1010 with blades longitudinally extending in the axial direction is disposed between the developing roll 1002 and the agitating means 1003. With rotation of the paddle wheel 1010, the developer separated from the developing roller 1002 is forcibly transferred toward the agitating means 1003, while the developer mixed and agitated by the agitating means 1003 is continuously supplied to the developing roll 1002.

Figure 3:
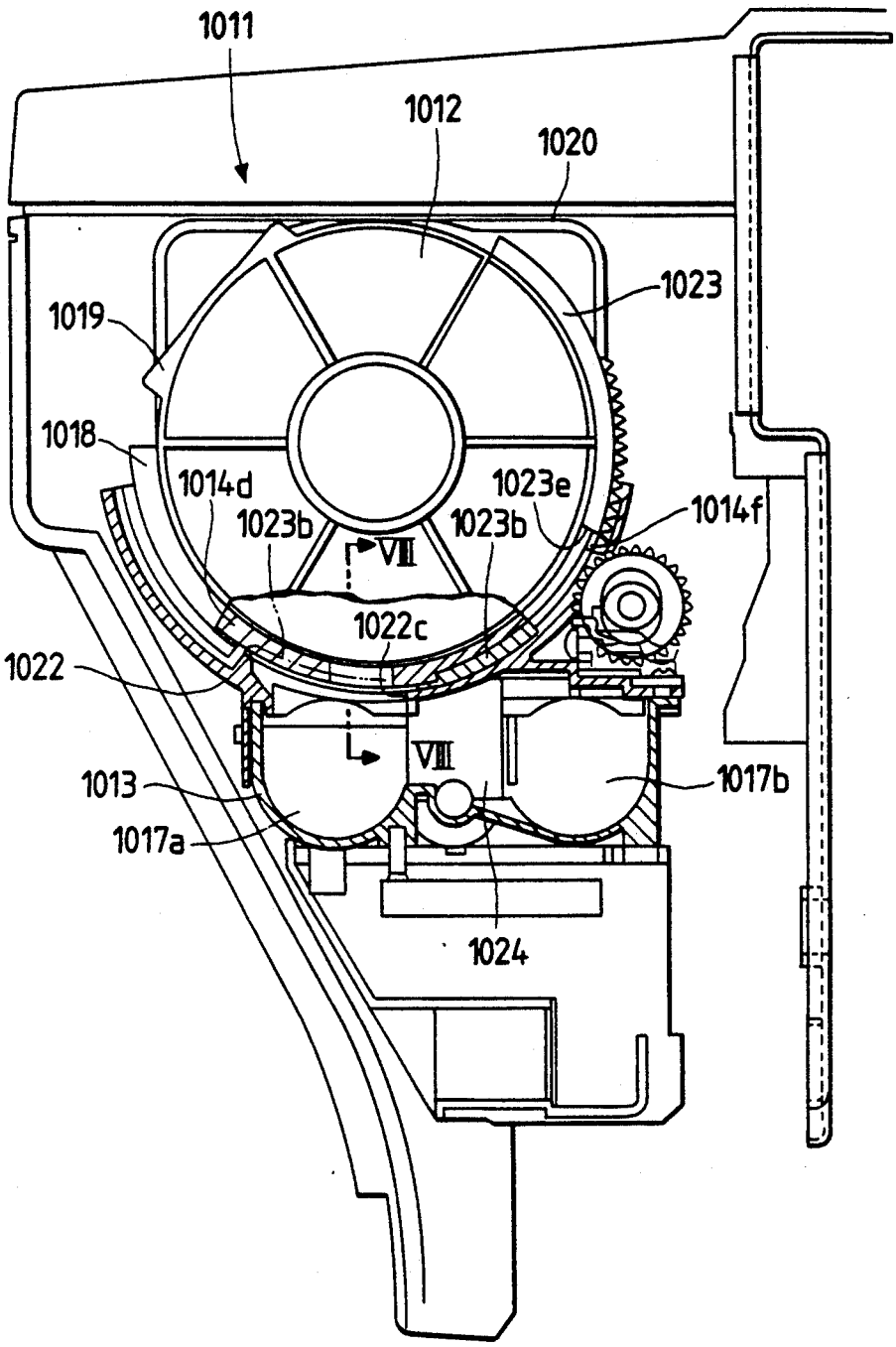
FIG. 3 is a cross sectional view showing a toner supply unit.
Figure 4:
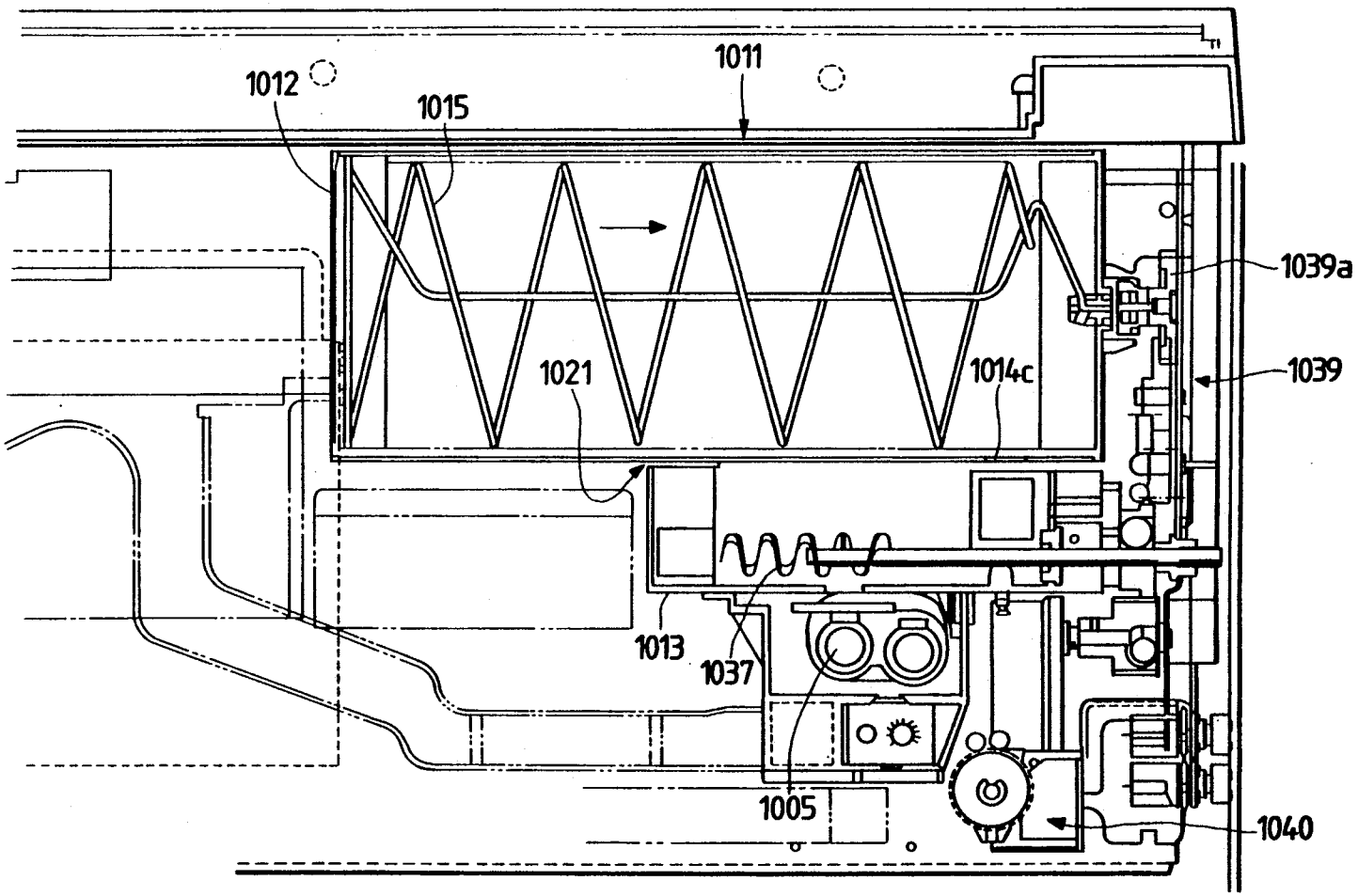
FIG. 4 is a longitudinal sectional view showing a toner supply unit.
Figure 5A:
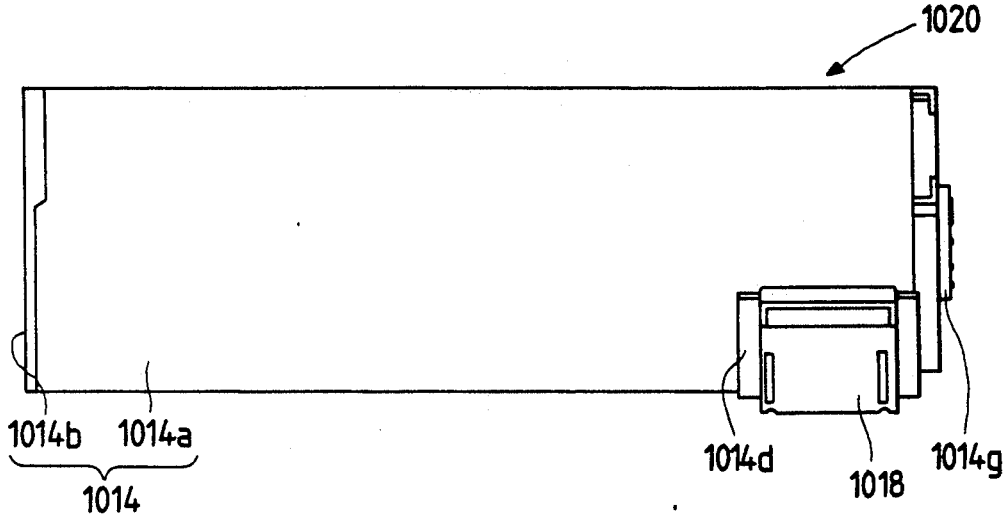
FIG. 5 shows diagrammatic views of a toner cartridge, in which FIG. 5(*a*) is a front view of the cartridge, FIG. 5(*b*) is a bottom view of the cartridge, FIG. 5(*c*) is a side view of the cartridge as viewed from the right side, FIG. 5(*d*) is a longitudinal sectional view of the cartridge as viewed in the axial direction, FIG. 5(*e*) is a cross sectional view taken on line VE—VE in FIG. 5(*d*), and FIG. 5(*f*) is a perspective view of the cartridge.
Figure 5B:
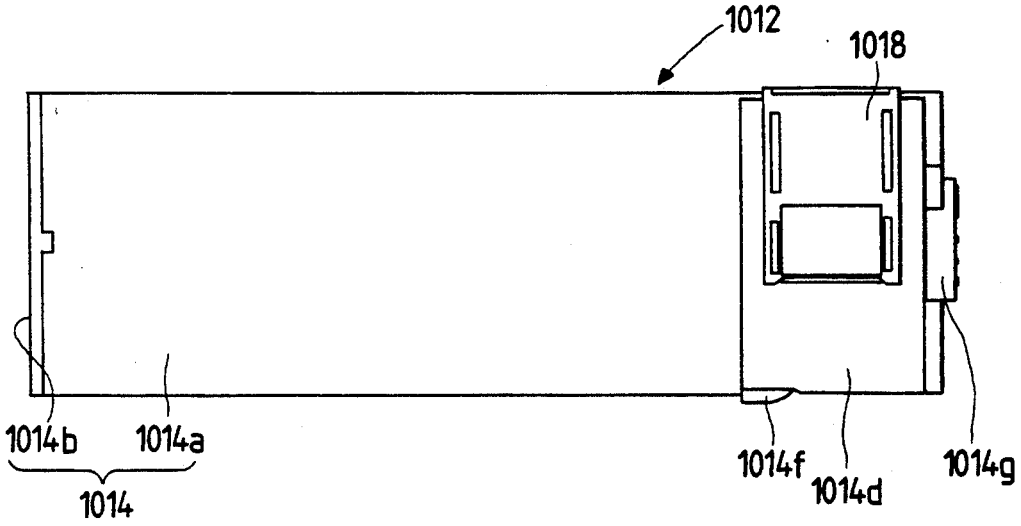
Figure 5C:
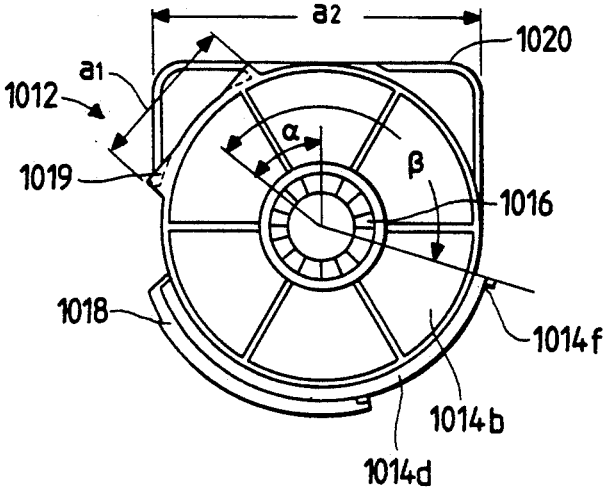
Figure 5D:
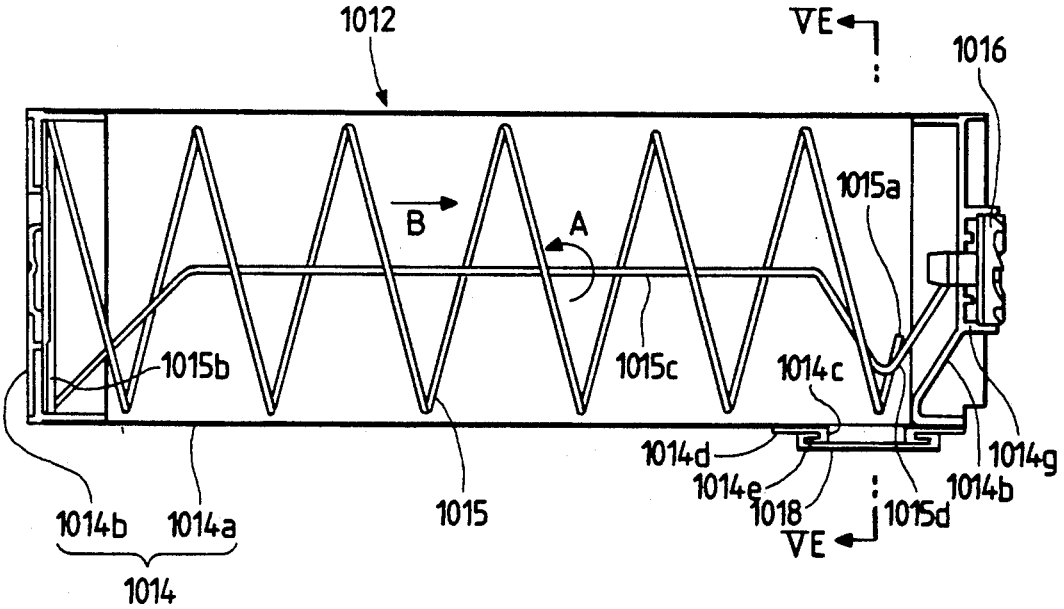
Figure 5E:
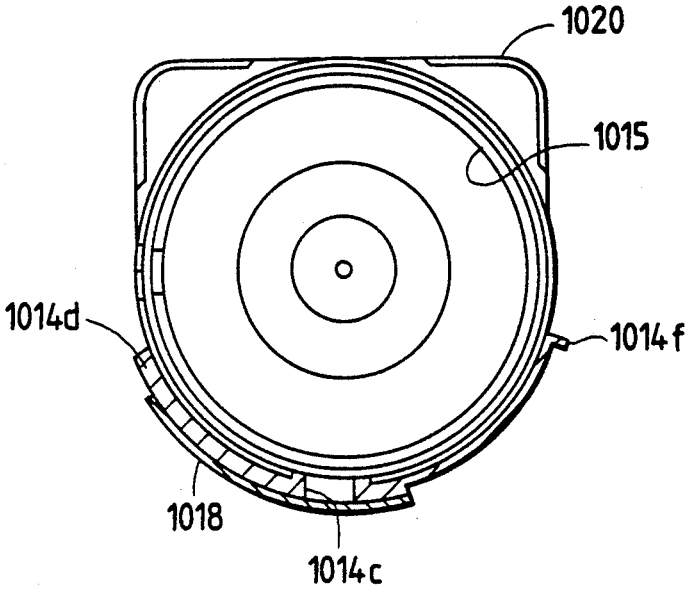
Figure 5F:
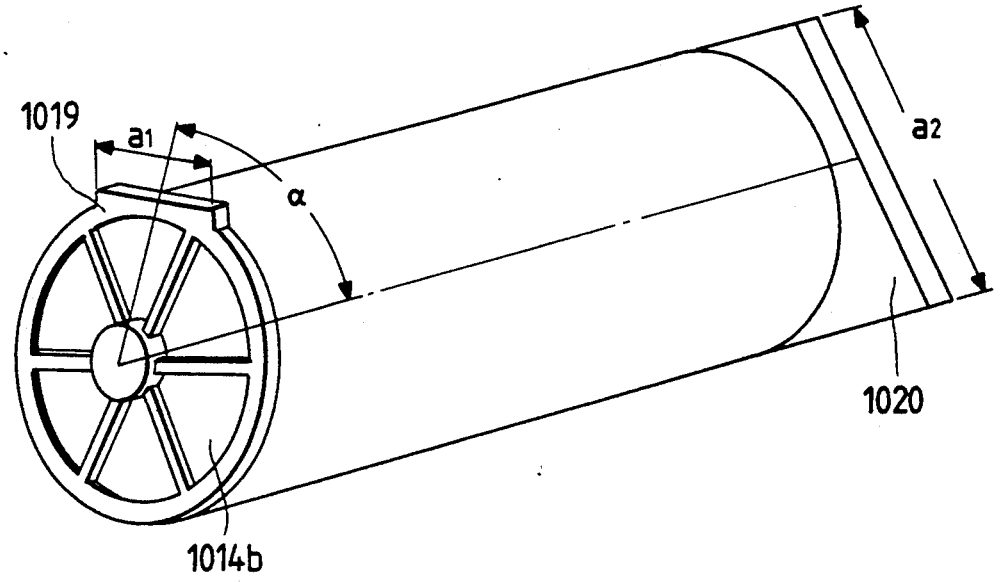
Figure 6A:
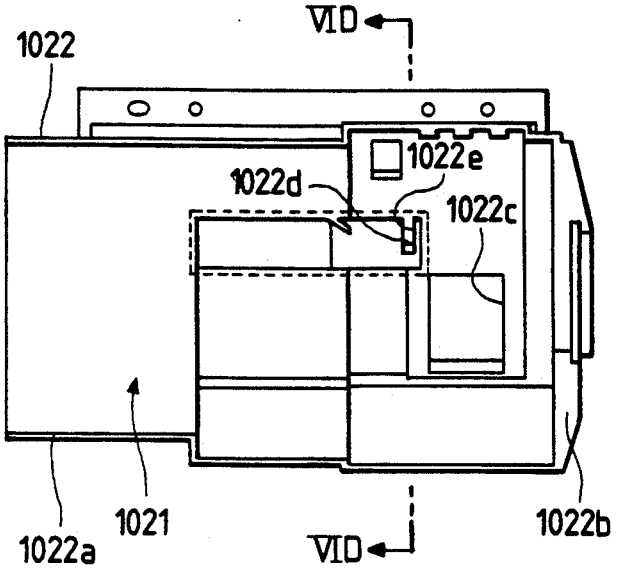
FIG. 6 shows diagrammatic views of a cover, in which FIG. 6(*a*) is a plan view of the cover, FIG. 6(*b*) is a front view of the cover, FIG. 6(*c*) is a side view of the cartridge as viewed from the right side, FIG. 6(*d*) is a longitudinal sectional view of the cover taken on line VID—VID in FIG. 6(*a*), and FIG. 6(*e*) is an enlarged view of a portion A.
Figure 6C:
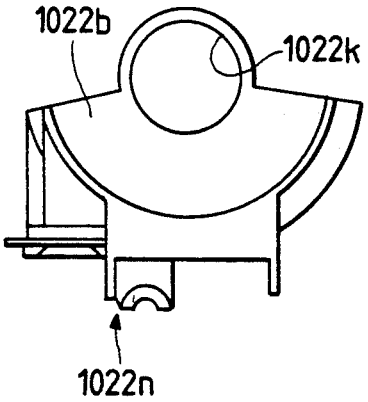
Figure 6B:
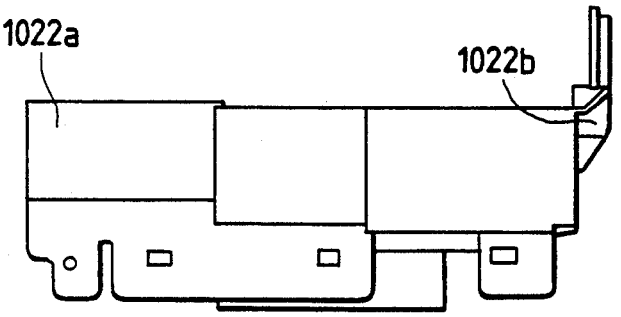
Figure 6D:
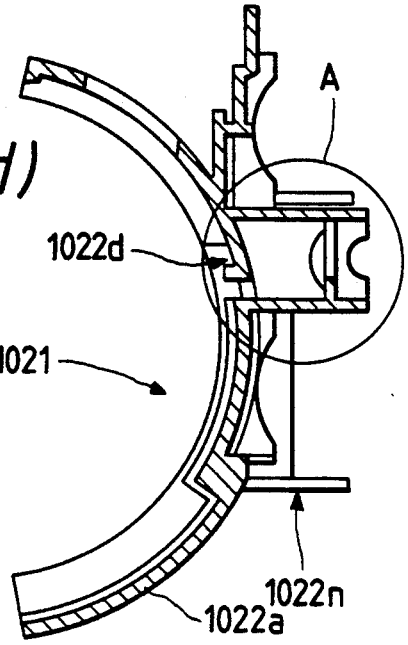
Figure 6E:
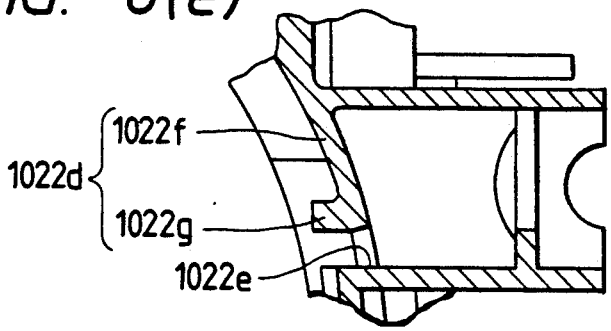

A toner supply unit 1011 is disposed above the first auger 1005 within the housing 1001, and includes a toner cartridge 1012 filed with toner, and a reserve tank 1013 disposed under the toner cartridge 1012, as shown in FIGS. 3 and 4.

As shown in FIGS. 5(*a*) through 5(*f*), the cartridge 1012 comprises a case body 1014, a spiral agitator 1015, and a coupling 1016. The case body 1014 includes a tubular portion 1014*a* made of paper, and end walls 1014*b* made of resin. The spiral agitator 1015 consists of metal wire spirally coiled. The coupling 1016 is coupled with the spiral agitator 1015. The tubular portion 1014*a*, when made of paper, is advantageous in several points. For example, since it can be cut, it is cut to adjust its length so as to be adaptable for different types of machines. Since the paper is cheap, cost to manufacture the cartridge 1012 may be considerably reduced.

A toner supply port 1014c for supplying toner to the reserve tank 1014 is formed in the tubular portion 1014a which is located close to one end portion of the case body 1023. The toner supply port 1014c opens to a toner container 1017a as one of the toner containers of a tank unit 1017 of the reserve tank 1013.

The end 1015a of the spiral agitator 1015, which is closer to the toner supply port 1014c, serves as a free end. The end 1015b of the agitator, which is opposite to the toner supply port, is rotatably supported by the inner surface of the end wall 1014b, and is integrally coupled with a drive force transmission shaft 1015c. The shaft 1015c extends along the axis of revolution of the spiral agitator 1015 towards the toner supply port 1014c. The distal end of the shaft is coupled with the coupling 1016, which is rotatably mounted on the center portion of the right-side end wall 1014b. A toner crushing member 1015d, shaped like a triangle protrusion, is formed at the portion of the drive force transmission shaft 1015c, which faces the toner supply port 1015d. Thus, the spiral agitator 1015 is cantilevered.

As shown in FIG. 5(*e*), a shutter 1018 is mounted on the cartridge 1012 circumferentially slidably. The shutter closes the toner supply port 1014c when the cartridge is not set to the toner supply unit. A guide member 1014d is provided on the outer surface of the tubular portion 1014a of the case body 1014 in the circumferential direction of the toner supply port 1014c. The guide member 1014d has guide grooves 1014e extending in the circumferential direction. Both ends of the shutter 1018 are bent, and engages with the guide grooves 1014e in a circumferentially slidable manner. A flexible sealing means (not shown) for closing the toner supply port 1014c is stuck on the case body 1014. The sealing means is fixed at one end to the shutter 1018. When the shutter 1018 is circumferentially slid, the sealing means is peeled off, with the movement of the shutter 1018, to open the toner supply port 1014c. An unlocking cam 1014f is provided at the right end of the guide member 1014d, which is located substantially opposite to the shutter 1018, as viewed in FIG. 5(*c*).

As shown in FIG. 5(*f*), first and second positioning means 1019 and 1020 are provided on the end walls 1014b, respectively. The first positioning means 1019 protrudes from the circumferential edge of the end wall 1014b, which is closer to the toner supply port 1014c. The end face of the first positioning means 1019 is flat. The second positioning means 1020 protrudes from the circumferential edge of the end wall 1014b, which is far from the toner supply port 1014c, and its end face is flat. As best shown in FIGS. 5(*c*) and 5(*f*), the second positioning means 1020 is angularly shifted from the first positioning means 1019 by an angle $\alpha$ in the clockwise direction. The flat end face $a_2$ of the second positioning means 1020 is wider than the end face $a_1$ of the first positioning means 1019. The angle $\alpha$ will be described later in detail.

The unlocking cam 1014f, as shown in FIG. 5(*c*), is angularly shifted from the first positioning means 1019 by a prescribed angle $\beta$ in the clockwise direction. The angle $\beta$ will be described in detail later.

As shown in FIGS. 3 and 4, the toner cartridge 1012 is removably set to a prescribed location of a cartridge set portion 1021 provided in the machine main body 2. As shown in FIGS. 6(*a*) through 6(*c*), the cartridge set portion 1021 is formed in a cover 1022 for closing an upper opening of the reserve tank 1013. The cover 1022 is formed, in one piece construction, of a semitubular frame 1022a, a side wall 1022b provided at one end of the frame 1022a, and a mounting portion 1022n fitted on the upper end of the reserve tank 1013.

A rectangular opening 1022c is formed at near to the middle of the frame and at a location closer to the side wall 1022b of the frame 1022a. As will be described later, through this opening 1022c, toner is supplied from the toner cartridge 1012 to the reserve tank 1013. As shown in FIG. 6(*d*), a lock 1022d is formed in the vicinity of the opening 1022c of the frame 1022a. As seen from FIG. 6(*e*), the lock 1022d includes an arm 1022f circumferentially extending from the frame 1022a within an opening 1022e formed in the frame 1022a, and a lock part 1022g, which at the tip of the arm 1022f, protrudes from the inner surface of the frame 1022a. When the arm 1022f, resiliently deformable, receives a force in the right direction in the drawing, the lock part 1022g retracts outwardly beyond the inner circumferential surface of the frame 1022a. When the force is removed, the lock part moves, by the resilient force, inwardly beyond the inner circumferential surface.

Figure 7A:
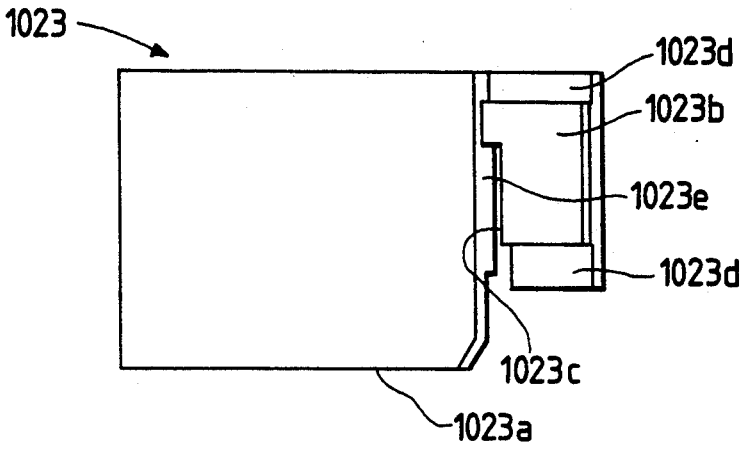
FIG. 7 shows diagrammatic views of a shutter, in which FIG. 7(*a*) is a plan view of the shutter, FIG. 7(*b*) is a front view of the shutter, and FIG. 7(*c*) is a side view of the shutter as viewed from the right side.
Figure 7B:
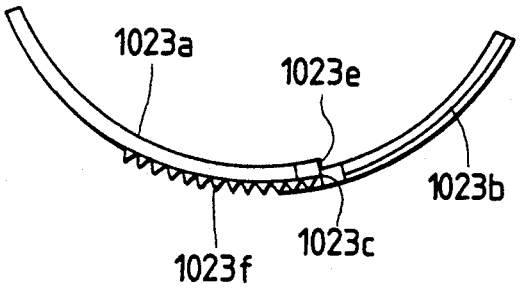
Figure 7C:
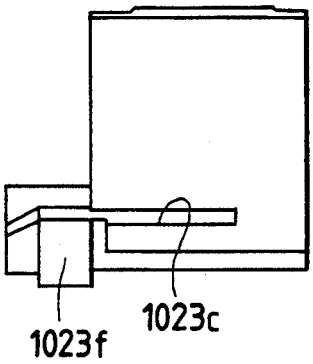

The opening 1022c of the frame 1022a of the cover 1022 is closed by the shutter 1023. As shown in FIG. 7, the shutter 1023, semicircular in cross section, includes a cartridge support 1023a for supporting the tubular portion 1014a of the toner cartridge 1012, and a shutter portion 1023b which supports the guide member 1014d of the toner cartridge 1012 and closes the opening 1022c. A cut-out groove 1023c of the predetermined width is present between the support 1023a and the shutter portion 1023b. When the shutter 1023 is set to a prescribed location of the frame 1022a of the cover 1022, the lock part 1022g of the lock 1022d is fitted into this groove 1023c, as will be described later in detail.

Figure 8:
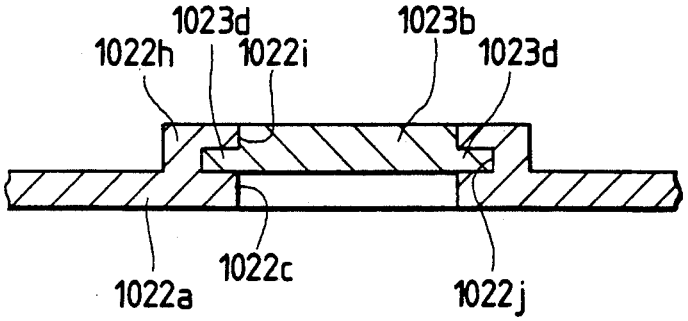
FIG. 8 is a cross sectional view taken on line VIII—VIII in FIG. 3.

The inner circumferential surfaces of both the ends of the shutter portion 1023b are stepped downward to form circumferentially extending, thinned parts 1023d. As shown in FIG. 8, each thinned part 1023d is fitted in a guide groove 1022j of the side wall of a concave portion 1022i elongated circumferentially along the guide member 1022h, which is provided near the opening 1022c of the frame 1022a. In this way, the shutter 1023 is assembled into the frame 1022a, while being circumferentially slidable. In a state that the shutter 1023 is assembled into the frame 1022a, the cut-out groove 1023c opens to the left with respect to the cover 1022 shown in FIG. 6(*a*). When the shutter 1023 is at the leftmost position where it completely closes the opening 1022c, as indicated by a two-dot chain line in FIG. 3, the lock 1022d is fitted into the cut-out groove 1023c. In this state, the shutter 1023 is circumferentially immovable, maintaining the closing state of the opening 1022c.

As shown in FIGS. 6(*c*), a circular hole 1022k is formed in the side wall 1022b. A tubular protrusion 1014g formed in the side wall 1014b, of the toner cartridge 1012 is inserted into the circular hole 1014b, when the toner cartridge 1012 is set. The cover 1022 thus constructed is set on the reserve tank 1013 in a state that the side wall 1022b of the cover is positioned on the side closer to a power transmission mechanism 1039 to be given later (on the right side in FIG. 4). The toner cartridge 1012 is precisely positioned and set for the reserve tank 1013 because of the one-piece construction of the frame 1022a, side wall 1014b, and the mounting portion 1022n, which support the toner cartridge 1012.

The prescribed angle $\beta$ between the first positioning means 1019 and the unlocking cam 1014f will be described. The angle $\beta$ is selected to be such a value that in a state that the planar surface $a_1$ of the first positioning means 1019 is directed upwardly and then horizontally, when the cartridge set portion 1021 is set to the cartridge set portion 1021, the unlocking cam 1014*f* axially faces the cut-out groove 1023*c*. Accordingly, when, after the toner cartridge 1012 is set to the cartridge set portion 1021, the toner cartridge 1012 is axially moved toward the side wall 1022*b* in a state that the first positioning means 1019 is held horizontally, the unlocking cam 1014*f* enters the cut-out groove 1023*c*. When the unlocking cam 1014*f* enters the cut-out groove 1021*c*, then the lock 1022*d* having been fitted into the cut-out groove 1023*c* is pushed by the unlocking cam 1014*f* and gets out of the groove 1023*c*.

Figure 9:
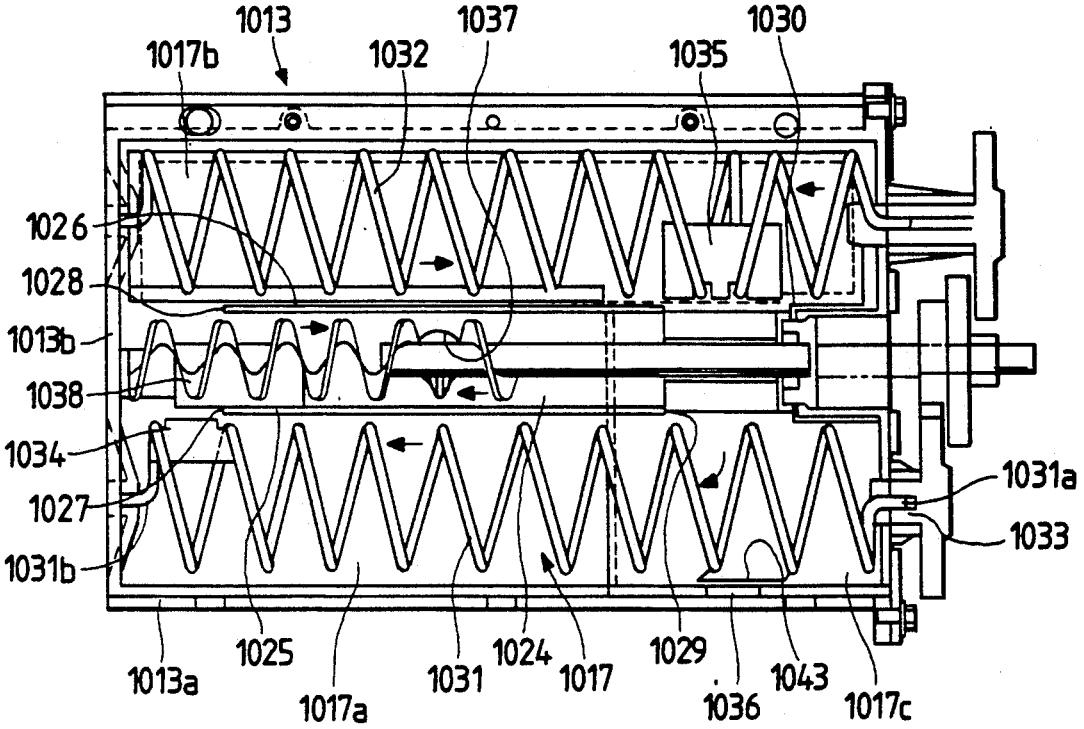
FIG. 9 is a horizontal sectional view showing a reserve tank.

As illustrated in FIGS. 3, 4 and 6, the reserve tank 1013 includes the tank unit 1017 consisting of toner containers 1017*a* and 1017*b*, and a toner supply section 1024, disposed between the containers 1017*a* and 1017*b*, for supplying toner to the developing means 53. Partition walls 1025 and 1026 are provided partitioning the toner containers 1017*a* and 1017*b*, and the toner supply section 1024. As best illustrated in FIG. 9, the partition walls 1025 and 1026 extend toward the left wall 1022*b* of the body 1013*a* of the reserve tank 1013, but fail to reach the wall, thereby to form openings 1027 and 1028 between the left wall 1013*b* and the left ends of the partition walls 1025 and 1026. The partition walls 1025 and 1026 have respectively openings 1029 and 1030 at locations deviated from the right ends to the left. Through the openings 1027, 1028, 1029, and 1030, the toner containers 1017*a*, 1017*b*, an the toner supply section 1024 communicate with one another.

Spiral agitators 1031 and 1032 formed of spirally coiled metal lines, for example, wires are disposed parallel to each other within the toner containers 1017*a* and 1017*b*. The right end 1031*a* of the spiral agitator 1031 is coupled with a gear shaft 1033, while the left end 1031*b* is rotatably supported by the left wall 1013*b*. The spiral agitator 1031 is coiled unidirectionally. A blade 1034 is mounted on the portion of the spiral agitator 1031, which faces the opening 1027. The other spiral agitator 1032 is also supported at both ends in a similar way. The coiling directions of the spiral agitator 1032 are opposite with respect to the opening 1030. In the left portion of the spiral agitator 1032 with respect to the opening 1030, the spiral agitator 1032 is coiled in the same direction as the coiled direction of the spiral agitator 1031, but in the right portion, it is coiled in the direction opposite to the former. A blade 1035 is mounted to the portion where the coiling direction is changed, viz., the portion facing the opening 1030.

A portion of the toner container 1017*a* on the right side of the opening 1029 serves as a toner introducing portion 1017*c*. An empty sensor 1036 is provided on the side wall of the body 1013*a* at a location somewhat to the left from the position facing the toner supply port 1014*c* of the cartridge 1012 in FIG. 9. The empty sensor 1036 is provided for sensing presence or absence of toner within the cartridge 1012.

A toner supply hole 1037 for supplying toner to the developing means 53 is provided at a prescribed position on the bottom of the toner supply section 1024. Within the toner supply section 1024 an auger 1049 is arranged in parallel to two spiral agitators 1031 and 1032. The auger 1038, like the spiral agitators 1031 and 1032 is also rotatably supported by the body 1013*a*. The coiling directions of the spirally coiled blade of the auger 1038 are opposite to each other with respect to the supply hole 1037.

In connection with the reserve tank 1013 thus constructed, when the cartridge 1012 is set to the cartridge set portion 1021 and ready for use, the shutters 1018 and 1023 slide and the toner supply port 1014*c* automatically opens concurrently with the sliding operation. Then, the toner is introduced from the cartridge 1012 to the toner introducing portion 1017*c* in the reserve tank 1013, through the toner supply port 1014*c* and the opening 1022*c*. With rotation of the spiral agitator 1031, the introduced toner is transferred to the left while at the same time is sensed by the empty sensor 1036. While the toner is transferred to the left, new toner is introduced into the toner introducing portion 1036, from the cartridge 1012. When the toner reaches the left end of the toner container 1017*a*, the toner is transferred, with the blade 1034, toward the toner supply section 1024, through the opening 1027. A part of the toner transferred to the toner supply section 1024 is transferred toward the supply hole 1037 by means of the auger 1038. The toner is further transferred through the toner supply hole 1037 toward the developing means 53. It is noted here that the toner, after passing the supply hole 1037, is returned to the supply hole 1037, with the blade of the auger 1038 of which the coiled direction is reversed, as recalled. Accordingly, the toner is reliably transferred toward the developing means 53, through the supply hole 1037.

The remaining part of the toner transferred to the toner supply section 1024 is pushed forwardly by new incoming toner transferred by the blade 1034, and flows through the opening 1028 to the toner container 1028. In the toner container 1017*b*, the toner is transferred toward the right opening 1030 by means of the spiral agitator 1032. The toner reaches the opening 1030 and is transferred, by the blade 1035, to the toner container 1017*a* through the openings 1030 and 1029. The toner, even if passing the opening 1030, is returned to the opening 1030 by the spiral agitator 1032 reversely coiled.

The toner, when entering the toner container 1017*a*, is transferred again to the left by the spiral agitator 1031. In this case, the toner is reliably transferred to the left by the spiral agitator 1031, so that the toner coming through the opening 1029 will not be transferred to the right or toward the toner introducing portion 1017*c*. Consequently, only the toner supplied from the cartridge 1012 is introduced into the toner introducing portion 1017*c*.

In this way, a prescribed amount of toner within the reserve tank 1013 is transferred from the supply hole 1037 to the developing means 53, while the remaining toner circulates between the toner containers 1017*a* and 1017*b*. The toner circulation prevents the toner from lumping within the containers 1017*a* and 1017*b*.

The volumes of the toner containers 1017*a* and 1017*b* are selected such that 2000 to 3000 number of copies can be made till a new cartridge is set after the cartridge 1012 is empty.

Figure 10:
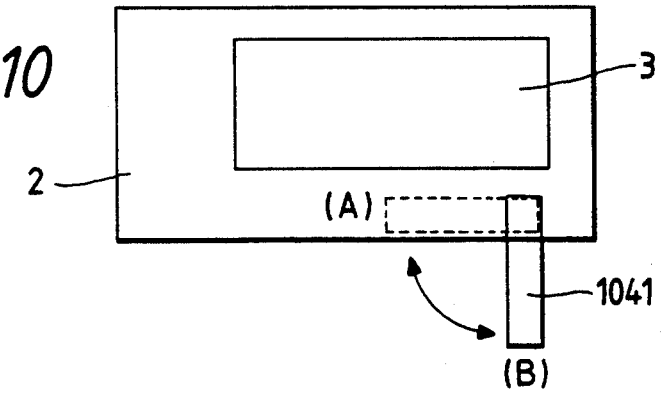
FIG. 10 is a view showing how the toner cartridge is loaded.

As shown in FIG. 10, a dispenser unit 1041, supported by the main body 2 of the copying machine, is swung between two positions A and B. The dispenser unit includes the cartridge 1012, cartridge set portion 1021, reserve tank 1013, power transmission mechanism 1039, and motor drive means 1040. In the position A as indicated by a broken line and extended laterally in the main body 2, the cartridge 1012 is set and used. In the position as indicated by a solid line and extended vertically in the main boy 2 and located outside the main body, the cartridge 1012 is replaced with a new one. For replacement of the cartridge 1012, the dispenser unit 1041 is turned to the replacing position B, an old cartridge 1012 is removed, and a new cartridge is set in the cartridge set portion 1021. Thereafter, the dispenser unit 1041 is turned to the position A and fixed thereat.

Description to follow is how the toner cartridge 1012 is set to the cartridge set portion 1021. As shown in FIG. 10, a user first turns the dispenser unit 1041 to the replacing position B, and, as shown in FIGS. 3 and 4, sets the toner cartridge 1012 on the cartridge set portion 1021. In this case, the first positioning means 1019 of the cartridge 1012 is positioned above and directed horizontally. In this state, the toner cartridge 1012 is axially moved forwardly (to the right in FIG. 4).

In a case where the toner cartridge 1012 is a toner cartridge designed to be used exclusively for the copying machine under discussion, the unlocking cam 1014*f* of the toner cartridge 1012 is placed facing the cut-out groove 1023*c*. Therefore, the unlocking cam 1014*f* is fitted into the cut-out groove 1023*c*. Under this condition, the toner cartridge 1012 is allowed to move up to a prescribed position on the axial path along which the tubular protrusion 1014*g* is fitted into the circular hole 1022*k* of the cover 1022. If the cartridge 1012 is used for another copying machine or an imitative cartridge, the unlocking cam 1014*f* is placed not facing the cut-out groove 1023*c*. Accordingly, the unlocking cam 1014*f* cannot be fitted into the cut-out groove 1023*c*, and hence the toner cartridge cannot be moved up to the prescribed position. Accordingly, such a cartridge cannot be set to the cartridge set portion 1021. Consequently, a mistaken loading of the toner cartridge can be prevented.

When the unlocking cam 1014*f* is inserted into the cut-out groove 1023*c*, the cam 1014*f* pushes the lock 1022*d* to expel it out of the cut-out groove 1023*c*. Then, the shutter 1023 is slidable in the circumferential direction. In this state, if the toner cartridge 1012 is turned counterclockwise in FIG. 3 (the user feels as if he turns it clockwise), the end 1014*h* of the guide member 1014*d* closer to the guide member 1014*f* comes in contact with the end 1023*e* of the cartridge support 1023*a* closer to the shutter portion 1023*b*. Accordingly, the shutter 1023 turns together with the toner cartridge 1012. With rotation of the shutter 1023, the opening 1022*c* of the cover 1022 is opened. One end 1018*a* of the shutter 1018 of the toner cartridge 1012 engages with the engaging part 1022*m*. As a result, if the toner cartridge 1012 is turned, the shutter 1018 will not turn together with the cartridge. In other words, the shutter 1018 turns relative to the toner cartridge 1012, so that the toner supply port 1014*c* is opened. In this way, both the shutters 1018 and 1023 turn with the turn of the cartridge 1012, and the toner supply port 1014*c* and the opening 1022*c* automatically open. When the toner cartridge 1012 is turned, the guide groove 1014*e* forming part of the guide member 1014*d* is fitted into the concave portion 1022*i* of the guide member 1022*h*. The result is that the toner cartridge 1021 is immovable in the axial direction.

The toner cartridge 1012 is then turned by a prescribed angle $\alpha$. The second positioning means 1020 is horizontally directed, so that the toner cartridge 1012 is set in place. When the toner cartridge 1012 is set in place, the toner supply hole 1014*c* and the opening 1022*c* are both opened. Accordingly, toner is introduced from the toner cartridge 1012 into the toner introducing portion 1017*c* of the reserve tank 1017, through the toner supply hole 1014*c* and the opening 1022*c*. Finally, under this condition, the dispenser unit 1041 is turned to set the toner cartridge 1012 to the position A, to complete the setting of the toner cartridge.

When the toner in the cartridge 1012 is used up and the cartridge must be replaced with a new one, a user turns the dispenser unit 1041 to set the cartridge 1012 to the replacing position B. Then, he turns the cartridge 1012 till the first positioning means 1019 is directed horizontally in FIG. 3. In this state, the guide member 1014*d* slips out of the concave portion 1022*i* of the guide member 1022*h*, and the shutter 1023 turns to open the opening 1022*c*. The shutter 1018 also moves relative to the toner cartridge to close the toner supply port 1014*c*.

Then, under this condition, the toner cartridge 1012 is axially moved to the left in FIG. 4, and then the toner cartridge 1012 may be removed. With the movement of the toner cartridge 1012, the unlocking cam 1014*f* gets out of the cut-out groove 1023*c*, and the lock 1022*d* is fitted into the groove 1023*c*. The result is that the shutter 1023 is locked to be immovable in the circumferential direction. The user discards the empty toner cartridge and sets a new toner cartridge 1012 filled with toner. The operation of setting the new toner cartridge is the same as that mentioned above, and hence no further description will be given here.

The loading and replacement of the toner cartridge 1012 are performed as in the above-described manners. It is noted here that in the present embodiment, the toner supply port 1014*c* does not open till the shutter 1018 is moved with the swing of the toner cartridge 1012 when it is loaded, and the toner supply port 1014*c* does not close till the shutter 1018 is moved with the swing of the toner cartridge 1012 when it is removed. This feature of the invention successfully solved the problem of the prior art that toner spills from the cartridge to stain user's clothes and the floor. Further, since the toner supply port 1014*c* is automatically opened, the loading and replacement work of the toner cartridge 1012 is more simplified.

Further, it is noted that the first and second positioning means 1019 and 1020 are angularly shifted one from the other and the widths $a_1$ and $a_2$ of them are also different from each other. With this feature, a user can load the cartridge in the correct direction at all times. Additionally, a reliable turn angle of the cartridge can be secured by merely setting the first positioning means 1019 horizontally at the start of loading the cartridge and setting the second positioning means 1020 horizontally at the completion of loading the cartridge. With those features, the toner cartridge 1012 can be correctly loaded in position and posture in a simple manner. If a proper indication for guiding the cartridge loading, such as an arrow, is attached to a prescribed position of the cartridge, the cartridge loading is more exact.

When the toner cartridge 1012 is removed, the shutter 1023 surely closes the opening 1022*c*. Therefore, foreign matters, such as dust, will not enter the reserve tank 1013.

As seen from the foregoing description, the first and second positioning means of the toner cartridge are angularly shifted one from the other. This feature provides a more exact loading of the cartridge.

Further, in the invention, the toner supply port is opened and closed interlocking with the setting and removal motions of the toner cartridge. Therefore, in loading or removing the cartridge, toner will not spill from the cartridge, thereby eliminating soling of clothes, machine or floor with spilt toner. Consequently, the loading and replacement of the toner cartridge are easy, so that the work of the cartridge loading and replacement can be done more efficiently.

What is claimed is:

1. A toner cartridge for an image forming apparatus comprising;

a case body having a tubular portion and first and second end walls;

a first positioning means, radially protruding from said first end wall and having a flat end face, for positioning the toner cartridge at the start of loading the toner cartridge into the image forming apparatus, said first positioning means having a first length parallel to said first end wall and perpendicular to the radial direction, and said first positioning means being aligned with a first guide in said image forming apparatus at the start of loading the toner cartridge; and a second positioning means, radially protruding from said second end wall and having a flat end face, for positioning the toner cartridge at the completion of loading the toner cartridge, said second positioning means having a second length parallel to said second end wall and perpendicular to the radial direction, and said second positioning means being angularly shifted from said first positioning means, wherein the toner cartridge is rotated through an angle $\alpha$ after said first positioning means is aligned with said first guide to align said second positioning means with a second guide in the image forming apparatus, said angle $\alpha$ being defined by the perpendicular bisectors of said first and second lengths.

2. A toner cartridge for an image forming apparatus according to claim 1, further comprising;

a toner supply port for discharging toner contained therein;

a movable shutter for said opening toner supply port when the loading of said toner cartridge to said image forming apparatus is completed and for closing said toner supply port when said toner cartridge is removed from said image forming apparatus.

3. A toner cartridge for an image forming apparatus according to claim 1, wherein said case body is comprised of paper.

4. A toner cartridge for an image forming apparatus according to claim 1, further comprising;

an agitator formed within said case body.

5. A toner cartridge according to claim 4, wherein said agitator is comprised of spirally coiled metal wires.

* * * * *